US010056174B2

(12) United States Patent
Yamada

(10) Patent No.: US 10,056,174 B2
(45) Date of Patent: Aug. 21, 2018

(54) THERMISTOR MATERIAL FOR A SHORT RANGE OF LOW TEMPERATURE USE AND METHOD OF MANUFACTURING THE SAME

(71) Applicant: KABUSHIKI KAISHA TOYOTA CHUO KENKYUSHO, Nagakute-shi, Aichi-ken (JP)

(72) Inventor: Katsunori Yamada, Nagoya (JP)

(73) Assignee: KABUSHIKI KAISHA TOYOTA CHUO KENKYUSHO, Nagakute-shi (JP)

( * ) Notice: Subject to any disclaimer, the term of this patent is extended or adjusted under 35 U.S.C. 154(b) by 299 days.

(21) Appl. No.: 14/371,833

(22) PCT Filed: Mar. 19, 2013

(86) PCT No.: PCT/JP2013/057817
§ 371 (c)(1),
(2) Date: Jul. 11, 2014

(87) PCT Pub. No.: WO2013/141238
PCT Pub. Date: Sep. 26, 2013

(65) Prior Publication Data

US 2014/0374674 A1 Dec. 25, 2014

(30) Foreign Application Priority Data

Mar. 19, 2012 (JP) ..... 2012-062795

(51) Int. Cl.
*H01B 1/02* (2006.01)
*H01C 7/00* (2006.01)
(Continued)

(52) U.S. Cl.
CPC ..... *H01C 7/008* (2013.01); *H01C 7/042* (2013.01); *H01C 17/00* (2013.01); *H01B 1/02* (2013.01)

(58) Field of Classification Search
CPC ..... H01B 1/04; H01B 1/02
See application file for complete search history.

(56) References Cited

U.S. PATENT DOCUMENTS 6,143,207 A * 11/2000 Yamada ..... C04B 35/117 252/515
2011/0042627 A1* 2/2011 Yamada ..... H01C 7/008 252/516

FOREIGN PATENT DOCUMENTS

JP A-64-64202 3/1989
JP A-2000-348907 12/2000
(Continued)

OTHER PUBLICATIONS

Nov. 4, 2014 Office Action issued in Japanese Patent Application No. 2012-062795.
(Continued)

*Primary Examiner* — William Young
(74) *Attorney, Agent, or Firm* — Oliff PLC

(57) ABSTRACT

A thermistor material for a short range of low temperature use includes a matrix material composed of nitride-based and/or oxide-based insulating ceramics, conductive particles composed of α-SiC and dispersed in the grain boundary of each crystal grain of the matrix material so as to form an electric conduction path. The thermistor material further contains boron and second conductive particles added thereto, which are composed of a metal or an inorganic compound, having a specific electric resistance value at room temperature lower than that of the α-SiC and a melting point of 1700° C. or more. Such a thermistor material is produced by mixing matrix powder, conductive powder, second conductive powder, boron powder, and a sintering agent as necessary such that a temperature coefficient of resistance (B value) and a specific electric resistance value
(Continued)

at room temperature are each within a predetermined range, and molding and sintering the resultant mixture.

4 Claims, 2 Drawing Sheets

(51) Int. Cl.
*H01C 7/04* (2006.01)
*H01C 17/00* (2006.01)

(56) References Cited

FOREIGN PATENT DOCUMENTS

| | | |
|---|---|---|
| JP | A-2009-259911 | 11/2009 |
| WO | WO 98/12714 A1 | 3/1998 |

OTHER PUBLICATIONS

International Search Report issued in International Patent Application No. PCT/JP2013/057817 dated Jun. 25, 2013.
International Preliminary Report on Patentability issued in International Patent Application No. PCT/JP2013/057817 dated Sep. 23, 2014.

* cited by examiner

[FIG. 1]
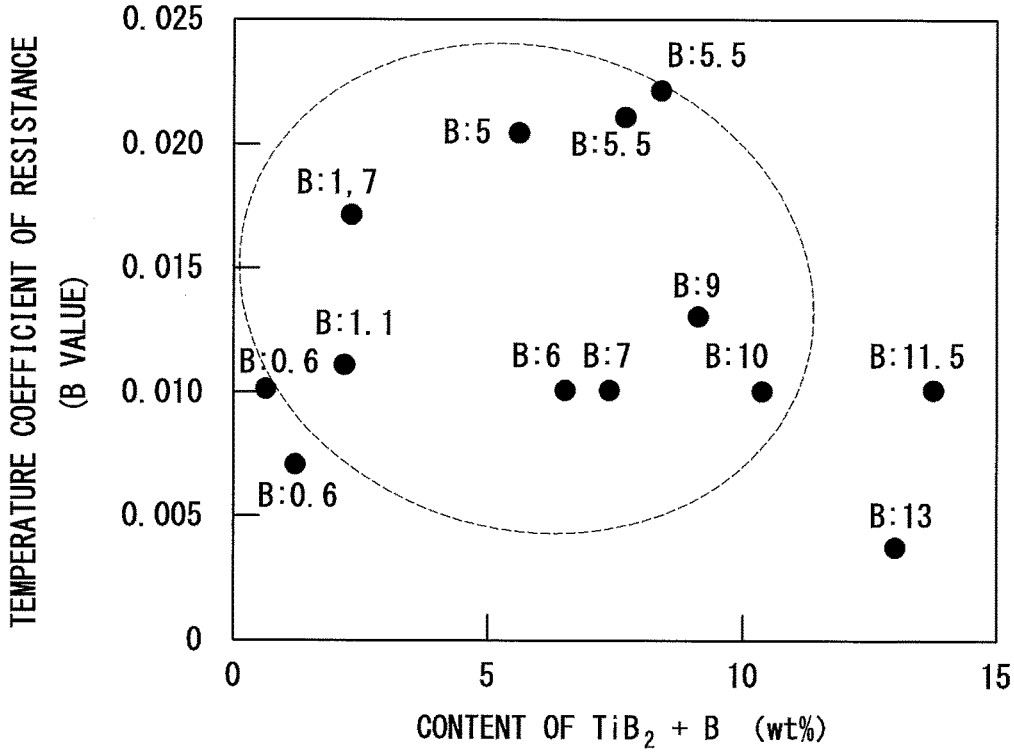
[FIG. 2]
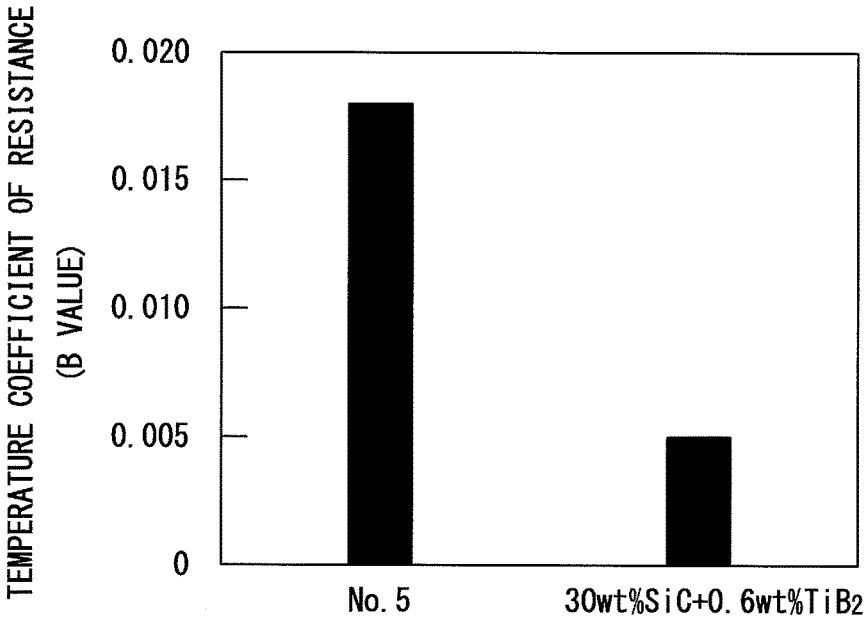

[FIG. 3]
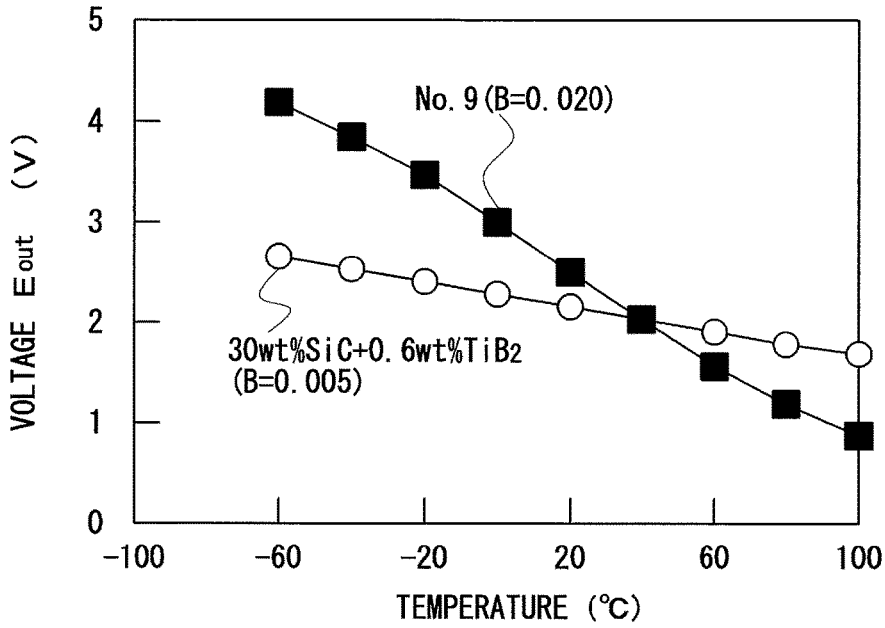
[FIG. 4]
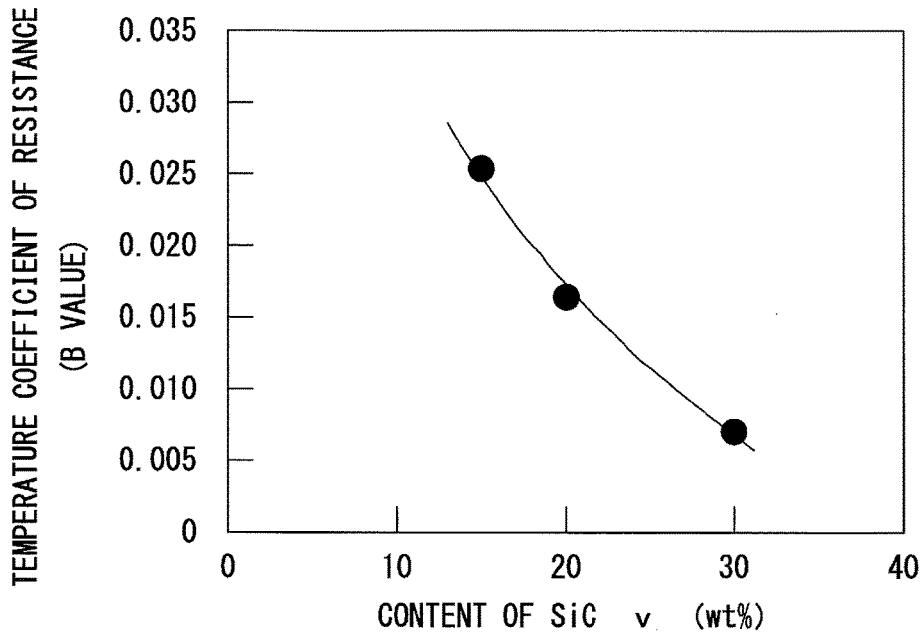

THERMISTOR MATERIAL FOR A SHORT RANGE OF LOW TEMPERATURE USE AND METHOD OF MANUFACTURING THE SAME

BACKGROUND

The present invention relates to a thermistor material for a short range of low temperature use and a method of manufacturing the thermistor material, and more specifically relates to a thermistor material for a short rang of low temperature use preferable for temperature measurement in a temperature range from about −80° C. to about 500° C., and a method of manufacturing the thermistor material.

The thermistor refers to a resistor showing great electric resistance change against temperature change. Thermistors are classified into a NTC thermistor the electric resistance of which decreases with an increase in temperature, a PTC thermistor the electric resistance of which increases with increase in temperature, and a CRT thermistor the electric resistance of which drastically decreases at more than certain temperature. Among them, the NTC thermistor is used most frequently since its electric resistance value varies proportionally with temperature, and simple "thermistor" refers to the NTC thermistor.

A typically used thermistor includes an oxide composite containing two to four types of transition metal oxides such as oxides of Mn, Ni, Co, Fe, and Cu. A Pt lead is necessary to be bonded to a thermistor element having a predetermined shape in order to use the thermistor as any of various sensors (for example, a temperature sensor usable in a high temperature region). In a known method of bonding the Pt lead, the Pt lead and raw material powder are integrally molded and sintered. In another known method, an electrode is formed on a surface of a sintered body by printing, and the Pt lead is bonded to the electrode surface. The thermistor element having the Pt lead bonded thereto is typically used while being sealed by glass seal or a metal tube in order to suppress time-dependent variation of an electric resistance value due to a factor other than temperature change.

However, in the case where the Pt lead and the raw material powder are integrally molded and sintered, and if sintering temperature of the raw material powder is excessively high, the Pt lead is disadvantageously degraded during the sintering. Even if the thermistor element is sealed by glass seal or a metal tube, time-dependent variation of an electric resistance value disadvantageously occurs due to change in gas composition in a sealed space.

Various proposals have been made in order to overcome such disadvantages.

For example, Patent Literature 1 discloses a wide-range thermistor produced by adding 8.7 to 8.8 wt % silicon carbide, 29.1 to 29.3 wt % yttrium oxide, 0.8 wt % titanium boride, and 0.2 to 2.0 wt % metal boron to silicon nitride, mixing them together, and molding and sintering the resultant mixture.

Patent Literature 1 describes that the wide-range thermistor shows a linear relationship between temperature and logarithm of specific electric resistance in a range from room temperature (25° C.) to 1050° C.

Patent Literature 2 discloses a thermistor material for use in a reducing atmosphere such as hydrogen gas, which is produced by adding 30 wt % SiC powder and 6 wt % $Y_2O_3$ to $Si_3N_4$ powder and mixing them together, and molding and sintering the resultant mixture.

Patent Literature 2 describes that the thermistor material for use in a reducing atmosphere shows a deterioration rate of an electric resistance of 1% or less when the thermistor material is exposed for 1000 hr under a hydrogen atmosphere of 120° C.×10 atm.

Furthermore, Patent Literature 3 discloses a thermistor material containing silicon carbide and/or boron carbide as a conductive substance and an oxide matrix.

Patent Literature 3 describes that the thermistor material shows a change rate of an electric resistance value to an initial value of less than 1% after the lapse of 3000 hr at 500° C.

To achieve high measurement accuracy when the thermistor material is used for temperature measurement in a certain temperature range, it is necessary that (a) the thermistor material has an appropriate electric resistance value in an operating temperature range, and (b) the thermistor material has a linear relationship between temperature (T) or a reciprocal of temperature (1/T) and logarithm of an electric resistance value (log R) in an operating temperature range (i.e., the thermistor material has an appropriate temperature coefficient of resistance (B value)). In the present invention, a constant B approximated by $R=A\exp(-BT)$ is defined as "temperature coefficient of resistance" or "thermistor constant."

The thermistor material described in Patent Literature 1 has a temperature coefficient of resistance (B value) of less than 0.01, and therefore allows temperature measurement in a wide range from room temperature to about 1000° C. However, if this composite is directly used for temperature measurement in a low temperature region from about −80° C. to about 500° C., detection accuracy is disadvantageously low since electric resistance change has a small absolute value for the range of temperature.

In the case of the thermistor material described in Patent Literature 2, since the conductive material includes only SiC, the electric resistance value and the temperature coefficient of resistance are difficult to be adjusted together to values suitable for measurement in the short range of a low temperature region.

Similarly, in the case of the thermistor material described in Patent Literature 3, since the temperature coefficient of resistance is determined by properties of silicon carbide, the electric resistance value and the temperature coefficient of resistance are difficult to be adjusted together to values suitable for measurement in a low temperature region. In addition, since the thermistor material is hardly sinterable, high temperature sintering is required to produce a dense sintered body. This is because if the sintered body has a low density, the electric resistance value may become high, or electric resistance becomes unstable.

CITATION LIST

Patent Literature

[Patent Literature 1]
Japanese Unexamined Patent Application Publication No. 2000-348907
[Patent Literature 2]
Japanese Unexamined Patent Application Publication No. 2009-259911
[Patent Literature 3]
Japanese Unexamined Patent Application Publication No. H01-064202

SUMMARY

An object of the present invention is to provide a thermistor material for a short range of low temperature use capable of accurately performing temperature measurement in a temperature range from about −80° C. to about 500° C., and a method of manufacturing the thermistor material.

To achieve the object, the thermistor material for a short range of low temperature use according to the present invention is summarized by having the following configuration.

(1) The thermistor material for a short range of low temperature use includes:

a matrix material composed of nitride-based and/or oxide-based insulating ceramics;

conductive particles composed of α-SiC;

second conductive particles composed of a metal or an inorganic compound of which the specific electric resistance value at room temperature is lower than the specific electric resistance value of the α-SiC and the melting point is 1700° C. or more;

boron; and a sintering agent as necessary, wherein at least the conductive particles and the second conductive particles are dispersed in a grain boundary of each of crystal grains of the matrix material or in a grain boundary of an aggregate of the crystal grains so as to form an electric conduction path.

(2) The thermistor material for a short range of low temperature use has:

a temperature coefficient of resistance (B value) of 0.010 to 0.025, and a specific electric resistance value at room temperature of 0.1 kΩcm to 2000 kΩm.

To form the electric conduction path, the grain size of each of the conductive particles and the second conductive particles is preferably smaller than the grain size of the crystal grain of the matrix material.

A method of manufacturing a thermistor material for a short range of low temperature use according to the present invention is summarized by having the following configuration.

(1) The method of manufacturing the thermistor material for a short range of low temperature use includes: mixing matrix powder composed of nitride-based and/or oxide-based insulating ceramics, conductive powder composed of α-SiC, which the temperature coefficient of resistance is larger in conductive materials, second conductive powder composed of a metal or an inorganic compound of which the specific electric resistance value at room temperature is lower than the specific electric resistance value of the α-SIC, and the melting point is 1700° C. or more, boron powder, and a sintering agent as necessary; and molding and sintering a mixture produced by the mixing.

(2) In the mixing process, the matrix powder, the conductive powder, the second conductive powder, the boron powder, and the sintering agent are mixed such that:

the thermistor material for a short range of low temperature use has a temperature coefficient of resistance (B value: thermistor constant) of 0.010 to 0.025, and the thermistor material for a short range of low temperature use has a specific electric resistance value at room temperature of 0.1 kΩcm to 2000 kΩcm.

The particle size of the matrix powder is preferably larger than the particle size of each of the conductive powder, the second conductive powder, and the boron powder.

In the thermistor material including the matrix material composed of insulating ceramics and the conductive particles composed of α-SiC, a predetermined amount of boron and a predetermined amount of second conductive particles (in particular, $TiB_2$ particles) are further added to the thermistor material, so that a thermistor material suitable for accurate temperature measurement in a low temperature region is produced.

This is possibly because the temperature coefficient of resistance (B value) is largely controlled by the content of the conductive particles and the content of boron, and the specific electric resistance value is largely controlled by the content of the second conductive particles.

BRIEF DESCRIPTION OF THE DRAWINGS

FIG. 1 is a diagram illustrating a relationship between a content of $TiB_2$+B contained in a thermistor material for a short range of low temperature use and a temperature coefficient of resistance (B value: thermistor constant);

FIG. 2 is a diagram illustrating a temperature coefficient of resistance (B value) of each of a thermistor material for a short range of low temperature use containing a predetermined amount of $TiB_2$ and a predetermined amount of B and a thermistor material containing 30 wt % SiC+0.6 wt % $TiB_2$;

FIG. 3 is a diagram illustrating a relationship between temperature and voltage of each of the thermistor material for a short range of low temperature use containing the predetermined amount of $TiB_2$ and the predetermined amount of B and the thermistor material containing 30 wt % SiC+0.6 wt % $TiB_2$; and FIG. 4 is a diagram illustrating a relationship between a content of α-SiC contained in the thermistor material for a short range of low temperature use ($TiB_2$: 0.6 wt % and B: 1.0 wt %) and a temperature coefficient of resistance.

DETAILED DESCRIPTION

Hereinafter, an embodiment of the present invention is described in detail.

[1. Thermistor Material for a Short Range of Low Temperature Use]

A thermistor material for a short range of low temperature use according to the present invention has the following configuration.

(1) The thermistor material for a short range of low temperature use includes:

a matrix material including nitride-based and/or oxide-based insulating ceramics;

conductive particles composed of α-SiC;

second conductive particles composed of a metal or an inorganic compound of which the specific electric resistance value at room temperature is lower than the specific electric resistance value of the α-SiC, and the melting point is 1700° C. or more;

boron; and a sintering agent as necessary, wherein at least the conductive particles and the second conductive particles are dispersed in a grain boundary of each of crystal grains of the matrix material or in a grain boundary of an aggregate of the crystal grains so as to form an electric conduction path.

(2) The thermistor material for a short range of low temperature use has:

a temperature coefficient of resistance (B value) of 0.010 to 0.025, and a specific electric resistance value at room temperature of 0.1 kΩcm to 2000 kΩcm.

[1.1. Matrix Material]

[1.1.1. Composition]

The matrix material includes nitride-based and/or oxide-based insulating ceramics. The matrix material may be a material including only nitride-based ceramics, a material including only oxide-based ceramics, or a material including a mixture of at least these two types of ceramics. The insulating ceramics preferably has a specific electric resistance of $10^{12}$ Ωcm or more.

The oxide-based ceramics composing the matrix material specifically include aluminum oxide, mullite, zirconia, magnesia, zircon, and spinel. In particular, aluminum oxide is particularly preferred as the matrix material since it has high durability under a reducing atmosphere.

The nitride-based ceramics composing the matrix material specifically include silicon nitride, sialon, and aluminum nitride. In particular, silicon nitride and silicon nitride-based sialon are particularly preferred as the matrix material since they have high durability under a reducing atmosphere.

[1.1.2. Grain Size and Aspect Ratio]

The crystal grain size of the matrix material can be optimally selected on the intended use without limitation. In general, if the crystal grain size of the matrix material is excessively small, the conductive particles and the second conductive particles are less likely to form an electric conduction path, leading to an increase in electric resistance value. Hence, the grain size of the matrix material is preferably 0.5 μm or more.

On the other hand, if the grain size of the matrix material is excessively large, sintering density is lowered. Consequently, the electric resistance value increases, or material strength is lowered. Hence, the grain size of the matrix material is preferably 10 μm or less.

The aspect ratio of the crystal grain of the matrix material is optimally selected to obtain an intended electric resistance value without limitation. In general, as the aspect ratio increases, grain distance of the conductive particles and the second conductive particles increases, and therefore the temperature coefficient of resistance (B value) and the electric resistance value can be increased.

[1.2. Conductive Particle]

[1.2.1. Composition]

The conductive particle is composed of a non-oxide-based conductive material having a specific electric resistance smaller than that of the matrix material. The specific electric resistance of the conductive particle is preferably $10^{-6}$ to $10^{6}$ Ωcm.

The conductive particles are dispersed with at least the second conductive particles described later in the grain boundary of each of the crystal grains of the matrix material and/or in the grain boundary of an aggregate of the crystal grains so as to form an electric conduction path. To form such an electric conduction path, the conductive particle is preferably composed of a material having a sintering temperature higher than that of the matrix material. To facilitate formation of the electric conduction path, the conductive particle preferably has a grain size smaller than that of the crystal grain of the matrix material, and is preferably composed of a material that does not forma compound with the matrix material at sintering temperature.

In the present invention, the conductive particle is composed of α-SiC. The α-SiC may not be or may be doped with boron. In addition, another impurity element (for example, N, P, Al, or the like) may be doped to SiC to increase the temperature coefficient of resistance. The α-SiC has high durability under a reducing atmosphere and a high temperature coefficient of resistance (B value), and is therefore preferred for the conductive particle of non-oxide material.

When the second conductive particles described later are further added in addition to the conductive particles composed of α-SiC, oxidation resistance and durability are advantageously improved compared with a case of using only α-SiC.

Furthermore, when a predetermined amount of second conductive particles and a predetermined amount of boron are further added in addition to the conductive particles composed of α-SiC, each of the electric resistance value and the temperature coefficient of resistance (B value) can be adjusted to a value suitable for the thermistor for a short range of low temperature use.

Although the conductive particles may be composed of β-SiC, β-SiC shows small electric resistance change against temperature, and is difficult to adjust the content.

[1.2.2. Grain Size]

The grain size of the conductive particle affects strength and the electric resistance value. In general, when the grain size of the conductive particle is excessively large, a relatively large amount of conductive particles is necessary to be added in order to ensure a predetermined electric resistance value. Excessive addition of the conductive particles accelerates formation of aggregates, causing reduction in strength of the material. Hence, the grain size of the conductive particle is preferably 5 μm or less. The grain size of the conductive particle is more preferably 1 μm or less.

[1.2.3. Content]

The content of the conductive particles affects the electric resistance, the temperature coefficient of resistance (B value), and the strength of the material. In general, if the content of the conductive particles is excessively small, the electric conduction path is less likely to be formed. Specifically, since the grain distance increases, the electric resistance of the material becomes excessively high. The content (or the added amount) of the conductive particles is preferably 15 wt % or more in order to ensure appropriate electric resistance and high strength. The content of the conductive particles is more preferably 17 wt % or more.

On the other hand, if the content of the conductive particles is excessively large, the electric resistance of the material becomes low. In addition, aggregates are more easily formed, and a discontinuous electric conduction path is difficult to be formed. Moreover, if the content of the conductive particles is excessively large, SiC particles aggregate to form origins of failure. As a result, strength is adversely lowered, and the temperature coefficient of resistance (B value) is rather reduced. The content of the conductive particles is preferably 30 wt % or less in order to ensure appropriate electric resistance, an appropriate temperature coefficient of resistance (B value), and high strength. The content of the conductive particles is more preferably 25 wt % or less.

[1.3. Second Conductive Particle]

[1.3.1 Composition]

The thermistor material for a short range of low temperature use according to the present invention further includes the second conductive particles in addition to the matrix material and the conductive particles. In manufacturing of the thermistor material for a short range of low temperature use, when the second conductive particles are further added into raw materials, the specific electric resistance value is more easily controlled.

Here, "second conductive particle" refers to particle composed of a metal or an inorganic compound of which the specific electric resistance value at room temperature is lower than that of α-SiC and the melting point is 1700° or higher. At least the second conductive particles configure part of the electric conduction path together with the conductive particles.

Specific second conductive particles include particles of (1) borides, nitrides, carbides, and silicides of elements of groups 4A, 5A, and 6A of the periodic table, and of (2) heat-resistant metal elements such as W and Mo.

In particular, $TiB_2$ is high in oxidation resistance, small in thermal expansion coefficient, and low in reactivity, and is therefore preferred for the second conductive particle.

[1.3.2 Grain Size]

Since detail of the grain size of the second conductive particle is similar to that of the conductive particle, description thereof is omitted.

[1.3.3 Content]

The second conductive particles largely affect the specific electric resistance value of the thermistor material for a short range of low temperature ase. When no second conductive particle is added, the specific electric resistance value often becomes excessively large.

The content (or the added amount) of the second conductive particles is preferably 0.6 wt % or more in order to ensure an appropriate specific electric resistance value. The content of the second conductive particles is more preferably 1.0 wt % or more.

On the other hand, if the content of the second conductive particles is excessively large, the specific electric resistance value becomes excessively small, and the temperature coefficient of resistance becomes small. Hence, the content of the second conductive particles is preferably 5.0 wt % or less. The content of the second conductive particles is more preferably 3.0 wt % or less.

[1.4. Boron]

The thermistor material for a short range of low temperature use according to the present invention further contains boron in addition to the matrix material, the conductive particles, and the second conductive particles. It is believed that the boron added in the raw materials may remain in the materials without reacting, or may exist in a form of another compound through diffusion into another raw material or reaction with another raw material. It is also believed that the added boron may configure part of the electric conduction path. In manufacturing of the thermistor material for a short range of low temperature use, when boron is further added into the raw materials, the temperature coefficient of resistance (B value; thermistor constant) is more easily controlled.

Boron largely affects the temperature coefficient of resistance (B value) of the thermistor material for a short range of low temperature use. When no boron is added, the temperature coefficient of resistance (B value) often becomes less than 0.01.

The content of boron is preferably 0.01 wt % or more in order to ensure a high temperature coefficient of resistance (B value) in the range of low temperature. The content of boron is more preferably 0.5 wt % or more, further preferably 1.0 wt % or more, further preferably 2.0 wt % or more, and most preferably 4.0 wt % or more.

On the other hand, when the content of boron is excessively large, the temperature coefficient of resistance (B value; thermistor constant) is rather lowered. Hence, the content of boron is preferably 12 wt % or less. The content of boron is more preferably 10 wt % or less, and most preferably 8 wt % or less.

[1.5. Sintering Agent]

The material may contain a sintering agent as necessary for high dense sintering. The composition of the sintering agent is optimally selected in accordance with the composition of each of the matrix material, the conductive particle, and the second conductive particle.

For example, in the case of a composite material of silicon nitride and silicon carbide, $Y_2O_3$, $Al_2O_3$, $MgAl_2O_4$, AlN, MgO, $Yb_2O_3$, $HfO_2$, and CaO are preferred as the sintering agent. One of such sintering agents may be used, or two or more of them may be used in combination. In particular, $Y_2O_3$, $Y_2O_3$—$MgAl_2O_4$, or $Y_2O_3$—$Al_2O_3$ is preferred. In the case of using $Y_2O_3$—$MgAl_2O_4$ as the sintering agent, the content of $Y_2O_3$ is preferably 4 to 10 wt %, and the content of $MgAl_2O_4$ is preferably 2 to 10 wt %.

[1.6. Electric Conduction Path]

The conductive particles are dispersed in a grain boundary of the matrix located in the periphery of each crystal grain of the matrix material and/or in the periphery of the aggregate of the plural crystal grains so as to form a major part of the electric conduction path. The second conductive particles configure part of the electric conduction path. While the conductive particles, the second conductive particles, and the crystal grains of the matrix material may be uniformly dispersed to one another, the conductive particles and the second conductive particles are preferably dispersed in a network structure in the crystalline grain boundary of the matrix material or in the periphery of an aggregate (cell) of plural crystal grains of the matrix material.

Here, "dispersed in a network structure" means that the conductive particles and the second conductive particles are disposed in the grain boundary so as to enclose the periphery of one or more crystal grains of the matrix material. When the conductive particles and the second conductive particles are disposed in the grain boundary to form the network structure, the electric conduction path can be uniformly formed over the entire matrix material.

The conductive particles and the second conductive particles are preferably dispersed discontinuously with predetermined distance rather than being densely dispersed so as to be in contact with one another. If the conductive particles configuring the major part of the electric conduction path are in contact with one another, the thermistor shows only the semiconductor properties of the conductive particles. In this case, the electric resistance value is saturated at a certain temperature or more; hence, the electric resistance value cannot be varied in a wide temperature range. In contrast, when the conductive particles configuring the major part of the electric conduction path are discontinuously dispersed, tunneling conduction or hopping conduction of electrons between the conductive particles are possibly superposed on the semiconductor properties of the α-SiC particles, so that the electric resistance value can be varied linearly over a wide temperature range.

The grain distance of the conductive particles and the second conductive particles affects the electric resistance value of the material. In general, if the grain distance of the conductive particles and the second conductive particles is excessively small, the electric resistance value is lowered, and a detectable temperature range is also reduced. Hence, the grain distance of the conductive particles and the second conductive particles is preferably 10 nm or more in average. In addition, if the grain distance of the conductive particles and the second conductive particles becomes excessively small, the temperature coefficient of resistance decreases considerably.

On the other hand, if the grain distance of the conductive particles and the second conductive particles becomes excessively large, the electric resistance value becomes large, and detection of a current value becomes difficult. Hence, the conductive particles and the second conductive particles preferably have a grain distance of 200 nm or less in average.

[1.7. Grain Size Ratio]

In general, as a grain size ratio of the crystal grains of the matrix material and/or the aggregate of the crystal grains to the conductive particles and the second conductive particles increases, the electric conduction path is formed into a network structure in less contents of conductive particles. A ratio ($=D_1/D_2$) of average grain size ($D_1$) of the crystal grains of the matrix material or the aggregate thereof to average grain size ($D_2$) of the conductive particles and the second conductive particles is preferably 1.5 or more. The grain size ratio ($D_1/D_2$) is more preferably 2.0 or more.

On the other hand, increasing the grain size ratio more than necessary decreases the density of a sintered body of the thermistor material, and does not have the practical benefits. Hence, the grain size ratio is preferably 100.0 or less. More preferably, the grain size ratio is 20 or less.

Here, "average grain size" means an average of largest lengths of particles or aggregates of the particles shown in observation of a cross section by a microscope.

[1.8. Total Content of Second Conductive Particles and Boron]

The second conductive particle has influence mainly on the specific electric resistance value of the material and furthermore on the temperature coefficient of resistance (B value). Similarly, boron has influence mainly on the temperature coefficient of resistance (B value) of the thermistor material and furthermore on the specific electric resistance value. Hence, not only the individual content of the second conductive particles and boron but also a total content of them is preferably optimized in order to optimize the temperature coefficient of resistance (B value) of the material. In general, when the total content is excessively large or excessively small, the temperature coefficient of resistance (B value) is lowered.

In the case where the second conductive particle is composed of $TiB_2$, the total content of the second conductive particles and boron is preferably 1 wt % or more in order to secure the temperature coefficient of resistance (B value) to be 0.01 or more. The total content is more preferably 2 wt % or more, and most preferably 3 wt % or more.

Similarly, the total content of the second conductive particles and boron is preferably 11 wt % or less. The total content thereof is more preferably 10 wt % or less, and most preferably 9 wt % or less.

[1.9. Temperature Coefficient of Resistance (B Value) and Specific Electric Resistance Value]

In general, as the temperature coefficient of resistance (B value) increases, temperature measurement in the short range of low temperature can be performed more accurately. However, if the temperature coefficient of resistance (B value) becomes excessively large, a relationship between temperature and electric resistance (voltage) cannot be linearly approximated (i.e., electric resistance change against temperature drastically decreases), and consequently measurement accuracy is rather reduced.

Moreover, in general, as the temperature coefficient of resistance (B value) increases, the specific electric resistance value also tends to increase. If the specific electric resistance value excessively increases, a current considerably decreases accordingly, and detection of voltage variation becomes difficult.

In contrast, if the content of each of the conductive particles, the second conductive particles, and boron is optimized, the temperature coefficient of resistance (B value) and the specific electric resistance value at room temperature of the material can each be adjusted to a value suitable for the thermistor material for a short range of low temperature use.

Specifically, through optimization of the content of each material, the temperature coefficient of resistance (B value) becomes 0.010 to 0.25. Through further optimization of the content of each material, the temperature coefficient of resistance (B value) becomes 0.015 to 0.025.

Similarly, through optimization of the content of each material, the specific electric resistance value at room temperature becomes 0.1 kΩcm to 2000 kΩcm. Through further optimization of the content of each material, the specific electric resistance value at room temperature becomes 10 kΩcm to 500 kΩcm.

[2. Method of Manufacturing Thermistor Material for a Short Range of Low Temperature Use]

A method of manufacturing the thermistor material for a short range of low temperature use according to the present invention includes a mixing process and a molding-and-sintering process.

[2.1. Mixing Process]

In the mixing process, matrix powder, conductive powder, second conductive powder, boron powder, and a sintering agent as necessary are mixed.

The raw material mixture may exclusively include the matrix powder, the conductive powder, the second conductive powder, and the boron powder, or may further include a sintering agent, a binder, a dispersant, and the like as necessary.

Details of the material composing each of the matrix powder, the conductive powder, the second conductive powder, and details of each of the boron powder and the sintering agent are as described above, and therefore description of them is omitted.

The content of each of the conductive powder, the second conductive powder, and the boron powder affects the temperature coefficient of resistance (B value) and the specific electric resistance value at room temperature of the thermistor material.

Hence, to allow accurate temperature measurement in a low temperature region, it is necessary to mix such raw materials such that (a) the temperature coefficient of resistance (B value) of the thermistor material for a short range of low temperature use is 0.010 to 0.025, and (b) the specific electric resistance value at room temperature of the thermistor material for a short range of low temperature use is 0.1 kΩcm to 2000 kΩcm.

When a material having a relatively low sintering temperature is used as the matrix material, and when a material having a relatively high sintering temperature is used as the conductive particle and as the second conductive particle, only crystal grains of the matrix material can be grown into an appropriate size without grain growth of the conductive particles and of the second conductive particles. According to such a technique, the conductive particles and the second conductive particles can be dispersed in a network structure in the grain boundary of each crystal grain of the matrix material and/or in the grain boundary of the aggregate of the crystal grains of matrix material. Grain distance and a dispersed state of conductive particles and the second conductive particles can be controlled by sintering temperature.

However, the conductive particles and the second conductive particles are more easily formed in a network structure by using powders having originally different average particle sizes as starting materials than by control using only sintering temperature. To achieve this, a ratio ($d_1/d_2$) of an average particle size ($d_1$) of the matrix powder to an average particle size ($d_2$) of the conductive powder and the second conductive powder is preferably 1.5 to 100.

Details of the content of each of the conductive powder, the second conductive powder, and the boron powder are as described above, and therefore description thereof is omitted.

[2.2. Molding-and-Sintering Process]

In the molding-and-sintering process, the mixture produced in the mixing process is molded and sintered.

An optimal molding process may be selected on the intended use without limitation. Specific examples of the molding process include a press molding process, a CIP molding process, a casting process, and a plastic forming process. A green compact may be subjected to green machining in order to reduce man-hour for finishing after sintering.

Sintering temperature is optimally selected depending on material compositions. In general, as the sintering temperature increases, a sintered body having higher density is produced. In addition, as the sintering temperature increases, grain growth of the crystal grains of the matrix material proceeds more actively, and the conductive particles and the second conductive particles are more easily dispersed in a network structure. For example, in the case of a $Si_3N_4$—SiC composite having a SiC content of 20 to 30 vol %, the sintering temperature is preferably 1800 to 1880° C.

Sintering time is optimally selected depending on the sintering temperature.

To produce a dense sintered body, pressure sintering such as hot press treatment or HIP treatment is preferred.

The resultant sintered body is cut into an appropriate size, and an electrode is bonded to either side of the cut sintered body, thereby the thermistor for a short range of low temperature use is yielded. Any of various materials may be used as a material for the electrode on the intended use without limitation. A material composed of a metal or a compound having a thermal expansion coefficient similar to that of the matrix material is preferred as a material for the electrode.

[3. Effects of Thermistor Material for a Short Range of Low Temperature Use and Method of Manufacturing the Same]

In the thermistor material for a short range of low temperature use according to the present invention, second-phase particles (the conductive particles and the second conductive particles) disperse in grain boundaries of the matrix material (a first phase), and the second-phase particles as a whole form a three-dimensional percolation structure. While the first phase is insulative, the second-phase particles are composed of a semiconductor (α-SiC) and a metallic conductive material (the second conductive particles). Furthermore, the second-phase particles are in proximity to one another in submicron or nanometer order so as to form the second phase. As a result, when a current is applied to the thermistor material having such a percolation structure, the current flows through the second phase as a route. In other words, the second phase acts as a part of electric conduction path.

When boron is further added to the thermistor material having such a electric conduction path, the temperature coefficient of resistance (B value) of the thermistor material increases while the specific electric resistance value thereof is appropriately maintained. If the stating material composition is optimized, the temperature coefficient of resistance (B value) becomes about 3.5 times as large as that of the wide-range thermistor described in Patent Literature 1. As a result, a detection voltage range in the short range of low temperature is expanded from 1-2 V to 0-4 V, which allows accurate temperature measurement to be performed even in a narrow temperature range.

In the thermistor material to which the second conductive particles and boron are added, the temperature coefficient of resistance (B value) is largely controlled by (1) a content of α-SiC (a semiconductor having a large temperature coefficient of resistance (B value)), i.e., the distance between segregated SiC particles in grain boundary of matrix material (electron conduction principle: hopping conduction is dominant compared with tunneling conduction), (2) a doped amount of B to α-SiC (control of temperature coefficient of resistance (B value) of α-SiC), and (3) a content of boron.

On the other hand, the electric resistance value of the thermistor material is largely controlled by the content of the second conductive particles.

While the principle of the fact that the temperature coefficient of resistance (B value) can be controlled by addition of boron is not clear, it is estimated that electron conduction through the composite material is hindered by addition of boron for some reason, and such a property appears more significantly due to temperature variation.

In one speculation, (1) the content of SiC is decreased in an allowable range of electron conduction, thereby electron conduction mainly occurs due to tunneling conduction mainly between neighboring SiC particles, (2) B-based compounds exist between SiC particles, thereby hopping conductivity or tunneling conductivity is further controlled, and (3) B itself is effect on a large temperature coefficient of resistance.

EXAMPLE

[1. Preparation of Specimen]

15 to 30 wt % α-SiC, 6 wt % $Y_2O_3$, 0 to 20 wt % B, and 0 to 5 wt % $TiB_2$ were added to commercially available $Si_3N_4$ powder (average particle size: 1.0 μm). Such materials were mixed in ethanol, and the resultant mixture was ball-milled and dried. The used α-SiC had a particle size ratio $d_{SN}/d_{SC}$ of 2.5 with respect to the $Si_3N_4$ powder.

The resultant mixed powder was uniaxially molded at a pressure of 20 MPa. Furthermore, the resultant green compact was sintered using hot-pressing to produce a thermistor material. A sheet-like temperature sensor element was cut out from the thermistor material, and electrodes were attached to the temperature sensor.

A thermistor material was fabricated according to the same procedure as that described above except that commercially available $ZrO_2$ powder (average particle size: 1.0 μm) or $Al_2O_3$ (average particle size: 1.5 μm) was used in place of the $Si_3N_4$ powder.

[2. Test Procedure]

The resultant thermistors were put in an electric furnace, and electric resistance values were measured at various temperatures. Specific electric resistance values were calculated from the resultant electric resistance values, so that temperature coefficients of resistance (B values) were determined using the relationship between electric resistance and the temperature, that is $R=A\exp(-B\cdot T)$, where R is the electric resistance of the thermistor material, T is the temperature.

[3. Results]

Table 1 shows a composition, a temperature coefficient of resistance (B value), and a specific electric resistance value at room temperature of each specimen. FIG. 1 illustrates a relationship between a content of $TiB_2$+B and the temperature coefficient of resistance (B value). FIG. 2 illustrates a temperature coefficient of resistance (B value) of each of a thermistor material for a short range of low temperature use containing a predetermined amount of $TiB_2$ and a predetermined amount of B and a thermistor material containing 30 wt % SiC+0.6 wt % $TiB_2$. Furthermore, FIG. 4 illustrates a relationship between a content of α-SiC ($TiB_2$: 0.6 wt % and B: 1.0 wt %) and a temperature coefficient of resistance. Table 1 and FIGS. 1, 2, and 4 reveal the following.

(1) In the case where one of B and $TiB_2$ is added, the temperature coefficient of resistance (B value) is less than 0.01, or the specific electric resistance value at room temperature exceeds 25 MΩcm (Nos. 21 to 26).

(2) Even though both B and $TiB_2$ are added, if the content of each of SiC, B and/or $TiB_2$ is relatively small, the specific electric resistance value at room temperature also exceeds 25 MΩcm (No. 22).

(3) In the case where both B and $TiB_2$ are added, and when an appropriate amount of SiC is added, the temperature coefficient of resistance (B value) becomes 0.010 to 0.025, and the specific electric resistance value at room temperature becomes 0.1 kΩcm to 2000 kΩcm (Nos. 1 to 3, 5 to 6, 8 to 13, and 16 to 17).

(4) If the content of each of B, $TiB_2$, and SiC is optimized, the temperature coefficient of resistance (B value) becomes 0.010 to 0.025, and the specific electric resistance value at room temperature becomes 10 kΩcm to 500 kΩcm (Nos. 1, 7, 9 to 11, 16, and 17).

(5) If the content of $TiB_2$+B is adjusted to be within a range from 1 to 11 wt %, the temperature coefficient of resistance (B value) becomes 0.01 or more despite slight fluctuation (FIG. 1).

(6) When the content of $TiB_2$ and the content of B are each constant, the temperature coefficient of resistance (B value) decreases with an increase in the content of SiC (FIG. 4).

Each thermistor material with a pull-up resistance was assembled in a circuit, and output voltage versus temperature was measured. FIG. 3 illustrates a relationship between temperature and voltage of each of the thermistor material for a short range of low temperature use containing a predetermined amount of $TiB_2$ and a predetermined amount of B and the thermistor material containing 30 wt % SiC+0.6 wt % $TiB_2$.

In the case of the thermistor containing only $TiB_2$, the temperature coefficient of resistance is as small as 0.005. Hence, change range of output voltage against temperature is as small as about 1 V, and thus when the thermistor is used in a voltage range from 0 to 5 V, detection accuracy is lower. In contrast, in the case of specimen No. 9 containing B and $TiB_2$ together, the temperature coefficient of resistance is as large as 0.02, and therefore change range of output voltage against temperature becomes about 3.5 V.

Although the embodiment of the present invention has been described in detail hereinbefore, the present invention should not be limited thereto, and various modifications or alterations thereof may be made within the scope without departing from the gist of the present invention.

The thermistor material for a short range of low temperature use according to the present invention is usable as a temperature sensor to be used in a temperature range from about −80° C. to about 500° C.

What is claimed is:

1. A thermistor material for a short range of low temperature use, the thermistor material comprising:

a matrix material composed of nitride-based and/or oxide-based insulating ceramics;

first conductive particles composed of α-SiC;

second conductive particles composed of a metal or an inorganic compound of which the specific electric resistance value at room temperature is lower than the specific electric resistance value of the α-SiC and the melting point is 1700° C. or more;

boron; and optionally, a sintering agent,

TABLE 1

| No. | Matrix Materials | SiC (wt %) | $TiB_2$ (wt %) | B (wt %) | $TiB_2$ + B (wt %) | Temperature coefficient of resistance (B value) | Specific electric resistance value (kΩcm) |
|---|---|---|---|---|---|---|---|
| 1 | $Si_3N_4$ | 20 | 0.60 | 0.01 | 0.61 | 0.0100 | 103.10 |
| 2 | $Si_3N_4$ | 20 | 1.15 | 1.01 | 2.16 | 0.0110 | 3.04 |
| 3 | $Si_3N_4$ | 20 | 0.60 | 8.50 | 9.10 | 0.0130 | 1100.00 |
| 4 | $Si_3N_4$ | 30 | 0.60 | 0.61 | 1.21 | 0.0070 | 83.50 |
| 5 | $Si_3N_4$ | 20 | 0.60 | 1.69 | 2.29 | 0.0170 | 923.00 |
| 6 | $Si_3N_4$ | 30 | 1.20 | 11.80 | 13.00 | 0.0037 | 0.26 |
| 7 | $Si_3N_4$ | 15 | 0.60 | 5.90 | 6.50 | 0.0100 | 145.00 |
| 8 | $Si_3N_4$ | 15 | 0.60 | 6.76 | 7.36 | 0.0100 | 0.78 |
| 9 | $Si_3N_4$ | 20 | 0.60 | 5.00 | 5.60 | 0.0203 | 230.00 |
| 10 | $Si_3N_4$ | 15 | 0.60 | 9.80 | 10.40 | 0.0100 | 64.72 |
| 11 | $Si_3N_4$ | 15 | 2.30 | 11.50 | 13.80 | 0.0100 | 22.90 |
| 12 | $Si_3N_4$ | 15 | 2.95 | 5.41 | 8.36 | 0.0220 | 9.10 |
| 13 | $Si_3N_4$ | 17 | 2.30 | 5.40 | 7.70 | 0.0210 | 7.70 |
| 16 | $ZrO_2$ | 20 | 0.60 | 1.00 | 1.60 | 0.0130 | 214.00 |
| 17 | $Al_2O_3$ | 20 | 0.60 | 1.00 | 1.60 | 0.0120 | 80.00 |
| 21 | $Si_3N_4$ | 20 | 0.00 | 0.90 | 0.90 | 0.0050 | 3.00 |
| 22 | $Si_3N_4$ | 15 | 0.60 | 0.90 | 1.50 | 0.0254 | 105025.00 |
| 23 | $Si_3N_4$ | 17 | 0.60 | 0.00 | 0.60 | 0.0150 | 750000.00 |
| 24 | $Si_3N_4$ | 20 | 0.60 | 0.00 | 0.60 | 0.0090 | 2470.00 |
| 25 | $Si_3N_4$ | 17 | 1.10 | 0.00 | 1.10 | 0.0090 | 1202447.00 |
| 26 | $Si_3N_4$ | 20 | 2.20 | 0.00 | 2.20 | 0.0090 | 1667650.00 |

*specific electric resistance value: value at room temperature wherein at least the first conductive particles and the second conductive particles are dispersed in a grain boundary of each of crystal grains of the matrix material or in a grain boundary of an aggregate of the crystal grains so as to form an electric conduction path, the thermistor material for a short range of low temperature use having:

a temperature coefficient of resistance (B value) in a range of 0.010 to 0.025, and a specific electric resistance value at room temperature in a range of 0.1 kΩcm to 2000 kΩcm, the second conductive particles are composed of $TiB_2$, a content of the first conductive particles is in a range of 15 wt % to 25 wt %, a content of the second conductive particles is in a range of 0.6 wt % to 5.0 wt %, and a content of the boron is in a range of 0.01 wt % to 12 wt %.

2. The thermistor material according to claim 1, wherein the specific electric resistance value at room temperature is in a range of 10 kΩcm to 500 kΩcm.

3. The thermistor material according to claim 1, wherein a ratio ($=D_1/D_2$) of an average grain size ($D_1$) of the crystal grains of the matrix material or the aggregate of the crystal grains to an average grain size ($D_2$) of the conductive particles and the second conductive particles is in the range of 1.5 to 100.0.

4. The thermistor material according to claim 1, wherein a content of the first conductive particles is in a range of 15 wt % to 25 wt %, a content of the second conductive particles is in a range of 0.6 wt % to 2.95 wt %, and a content of the boron is in a range of 0.01 wt % to 11.8 wt %.

* * * * *